US007448470B2

(12) United States Patent
Brown et al.

(10) Patent No.: US 7,448,470 B2
(45) Date of Patent: Nov. 11, 2008

(54) MAINTENANCE STAND

(75) Inventors: Eugene R. Brown, Bennettsville, SC (US); Eugene R. Nelson, Venice, FL (US)

(73) Assignee: Aluminum Ladder Company, Florence, SC (US)

( * ) Notice: Subject to any disclaimer, the term of this patent is extended or adjusted under 35 U.S.C. 154(b) by 591 days.

(21) Appl. No.: 11/220,125

(22) Filed: Sep. 6, 2005

(65) Prior Publication Data

US 2007/0051559 A1 Mar. 8, 2007

(51) Int. Cl.
*E04C 5/00* (2006.01)

(52) U.S. Cl. ..... 182/63.1; 182/69.5; 182/69.6

(58) Field of Classification Search ..... 182/63.1, 182/69.5, 69.6, 130–132, 1, 62.5, 67.4, 68.1, 182/34.1
See application file for complete search history.

(56) References Cited

U.S. PATENT DOCUMENTS

| | | | | |
|---|---|---|---|---|
| 159,571 | A * | 2/1875 | Schmid | 182/62.5 |
| 2,828,166 | A * | 3/1958 | Herring | 182/101 |
| 2,972,392 | A * | 2/1961 | Kurvers | 182/148 |
| 3,126,112 | A | 3/1964 | Shaw et al. | |
| 3,263,832 | A | 8/1966 | Williams, Jr. et al. | |
| 3,596,735 | A * | 8/1971 | Denier et al. | 182/16 |
| 3,687,321 | A | 8/1972 | Goodhart et al. | |
| 4,214,849 | A | 7/1980 | Downing | |
| 4,930,598 | A * | 6/1990 | Murrill et al. | 182/69.5 |
| 5,145,029 | A * | 9/1992 | Blasdell et al. | 182/69.5 |
| 5,862,884 | A * | 1/1999 | Smith | 187/200 |
| 6,405,831 | B1 * | 6/2002 | Daniel, III | 182/127 |
| 6,640,928 | B1 * | 11/2003 | Ridley, Jr. | 182/68.1 |
| 6,772,860 | B1 * | 8/2004 | Nelson | 182/115 |
| 6,802,391 | B2 * | 10/2004 | Ganiere | 182/69.6 |
| 7,004,286 | B2 * | 2/2006 | Fredette | 182/62.5 |
| 7,128,186 | B2 * | 10/2006 | Ganiere | 182/63.1 |

FOREIGN PATENT DOCUMENTS

| | | |
|---|---|---|
| DE | 26 04 141 | 8/1977 |
| EP | 073 00 298 | 11/1995 |
| FR | 2567 181 | 1/1986 |
| JP | 300298 | 11/1995 |
| WO | 2006/063453 | 6/2006 |

* cited by examiner

*Primary Examiner*—Katherine Mitchell
*Assistant Examiner*—Candace L. Bradford
(74) *Attorney, Agent, or Firm*—Charles L. Schwab; Nexsen Pruet, LLC

(57) ABSTRACT

A wheeled maintenance stand for aircraft has a worker platform elevated by a pair of double scissor linkages, which have track and follower connections with a mobile base frame and the worker platform. A staircase with self-leveling steps is connected to a laterally outer side of one of the double scissor linkages. A power unit supplies fluid power for propelling the stand, operating the scissor linkages and steering. The upper worker platform has left, right and center rolling sections. A manually operated brake is provides for each of the rolling sections. Electric power, compressed air and cooling air are supplied to the upper work platform.

27 Claims, 16 Drawing Sheets

MAINTENANCE STAND

BACKGROUND OF THE INVENTION

The need for mobile maintenance platforms and stands has been recognized and various wheeled and transportable versions of such equipment have been made available for construction, servicing and repair of buildings, high lines and other equipment requiring an elevated worker support. There is a special need for an improved and mobile maintenance stand for servicing aircraft. Large aircraft require relatively tall maintenance stands, which require a relatively large base frame which needs to be mobile so it can be moved from place to place and into proper position for aircraft servicing.

BRIEF DESCRIPTION OF THE INVENTION

The maintenance stand includes a hydraulically operated adjustable height scissors lift worker platform with a stair and handrail system, which allows personnel to work safely at selected platform heights. The maintenance stand has an elevated height of at least thirty-seven feet eight and one half inches and a collapsed height of approximately eight feet. It has a wheeled base frame supporting a pair of double scissors lift linkages, which in turn support a worker platform. Collapsible stairways with self-leveling steps automatically adjust as the worker platform is raised and lowered by operation of hydraulic power actuators connected to the double scissors linkages. Certain stairways, attachments and accessory type components are removable to permit transport of the maintenance stand in a collapsed condition by rail, highway or aircraft.

The maintenance stand may be operated using a hand pendant connected to a control panel by a flexible control cable. The hand pendant permits an operator to view all movement of the stand from side, front and rear ground positions. While standing on the ground an operator can drive the steerable, power driven stand to the desired position at the aircraft being maintained. Using the pendant control, an operator can extend and lock the outriggers, raise the platforms to the desired height and climb the stairs to the upper platform level and extend the upper platforms to the desired position. The wheeled maintenance stand is an engine driven, self-propelled unit; however, it is provided with a removable tow bar for distant travel.

Compressed air and electric service are provided at the upper platform through conduit and cable reels mounted on the base frame. The upper platforms are provided cooling air through interconnected rigid and flexible ducts mounted on the scissor arms of the scissors linkage.

BRIEF DESCRIPTION OF THE DRAWING

One embodiment of the invention is illustrated in the accompanying drawings, in which.

DETAILED DESCRIPTION OF THE INVENTION

Figure 5:
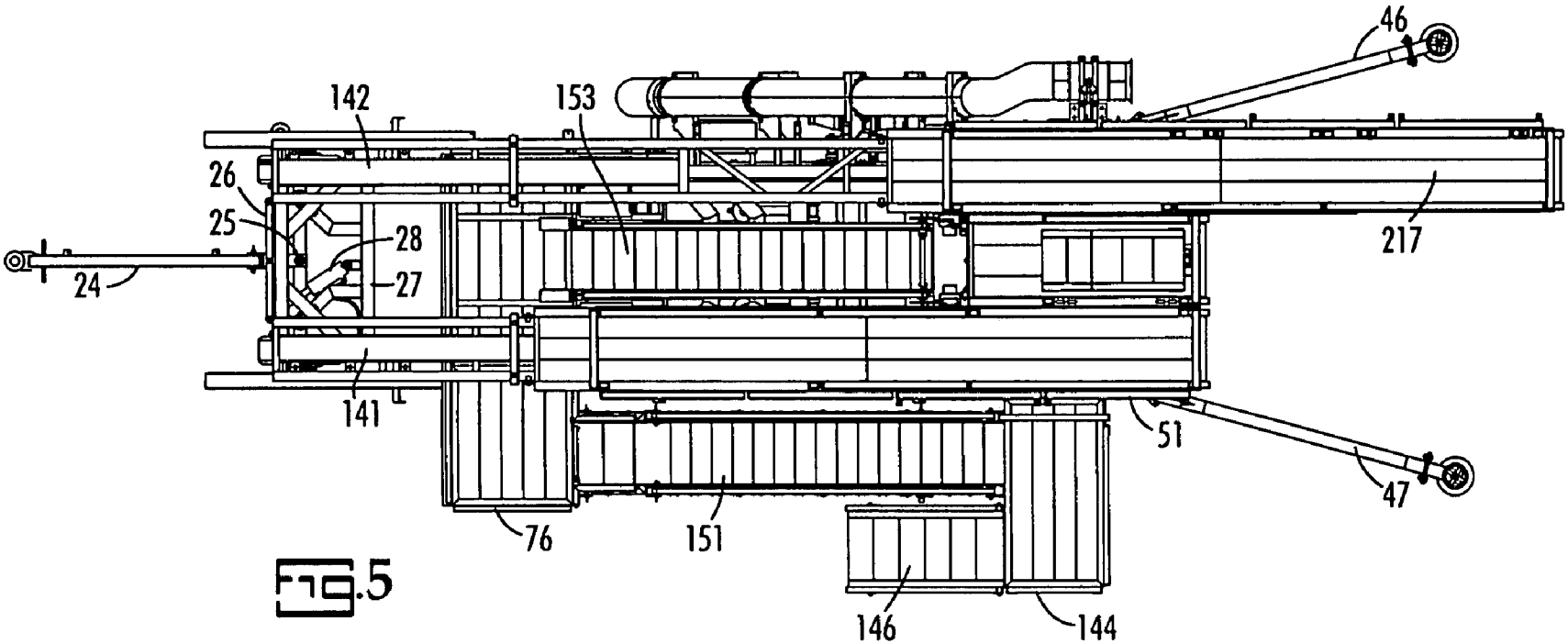
FIG. 5 is a top view of the maintenance stand shown in FIG. 3.

The maintenance stand shown in FIGS. 1 through 5 includes a horizontally elongated wheeled base frame 21 supported at its front end by a pair of laterally spaced steerable front wheels 22, 23 mounted on king pins, not shown, to which a removable tongue or tow bar 24 is connected through a transverse tie bar 26 of an Ackerman steering assembly, as shown in FIG. 5. The rear end of the tongue 24 is pivotally connected on a vertical pivot axis 25 to a frame member 27 of the base frame 21. The maintenance stand includes a power module 30 on the rear end of the base frame 21 and is selectively power steered by a hydraulic steering ram 28 interconnected between the base frame 21 and the Ackerman steering assembly. The steering ram 28 is controlled by a solenoid valve 29 of the control system shown in FIG. 22. The base frame 21 is supported at its rear end by a pair of laterally spaced rear wheels 31, 32.

Figure 22:
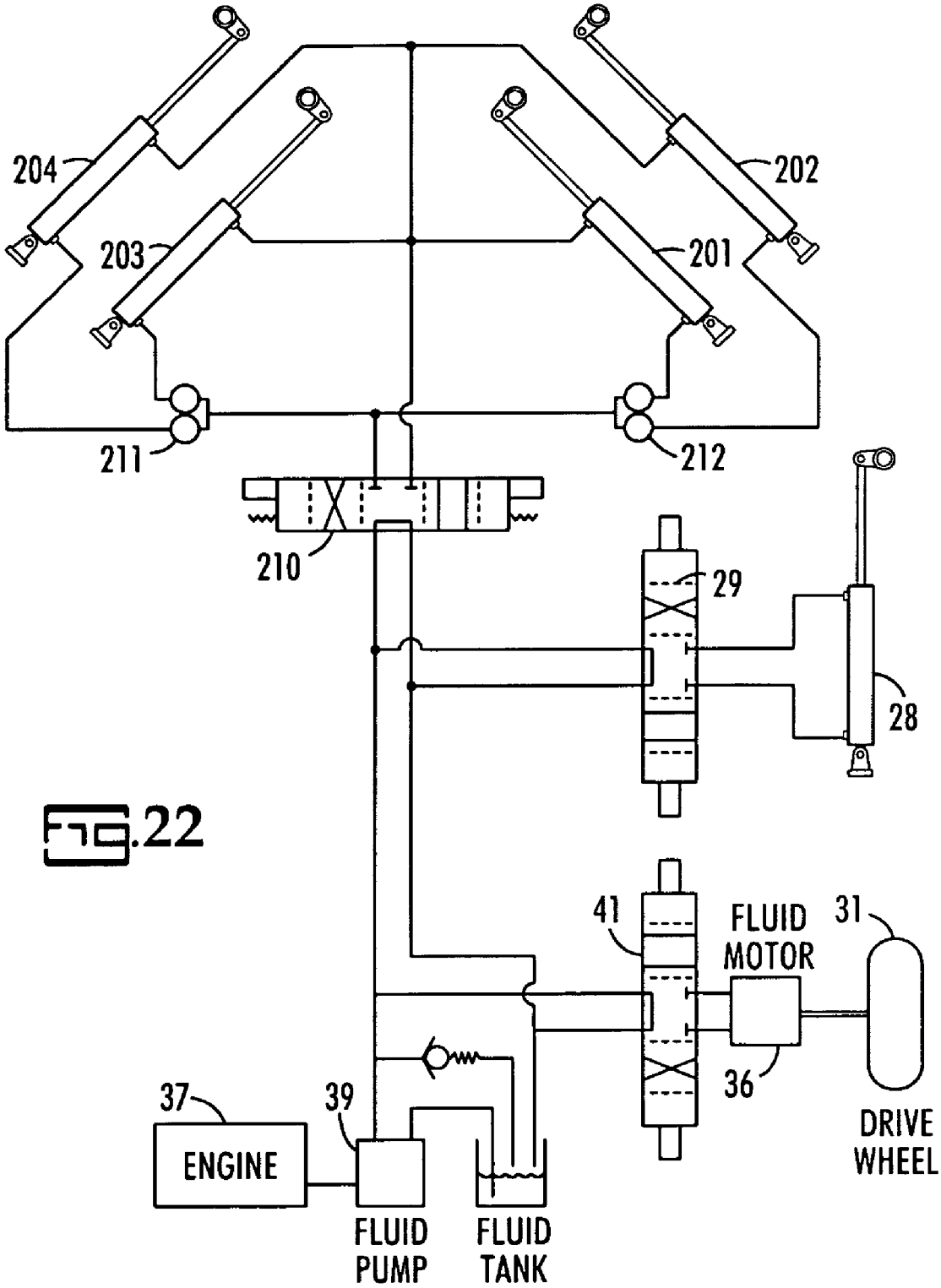
FIG. 22 is a schematic illustration of a power and control system.

Referring also to FIG. 22, an internal combustion engine 37, housed in an enclosure 38 of the power module 30, drives a fluid pump 39 supplying pressure fluid to a fluid motor 36 through a control system including an electrically operated solenoid valve 41 having forward, reverse and neutral control positions of adjustment. The left rear wheel 31 is selectively driven by the fluid motor 36 which has a built in spring biased brake, not shown. The built in brake is released when pressurized fluid is supplied to the motor 36. A suitable commercially available fluid motor with a built in brake is available from Sauer Daufoss, 500 Barclay Blvd., Lincolnshire, Ill.

The base frame 21 is stabilized by right and left outriggers 46, 47 which are pivotally connected to the right rear and the left rear corners of the base frame on vertical pivot axes. Vertically adjustable leveling swivel pads 48 are threadingly mounted on vertically axes on the distal ends of the outriggers 46, 47.

As shown in FIGS. 1 through 5, an upper worker platform 51, elongated horizontally fore and aft in relation to the base frame 21 and in parallel relation to the base frame, includes an upper platform support frame 52 which is supported on the base frame 21 by a pair of laterally spaced left and right, or first and second, double scissors linkages 53, 54. The left double scissor linkage 53 includes a laterally inner lower arm 56, a laterally outer lower arm 57, a laterally inner upper arm 58 and a laterally outer upper arm 59. The right double scissors linkage 54 includes a laterally inner lower arm 61, a laterally outer lower arm 62, a laterally inner upper arm 63 and a laterally outer upper arm 64. The laterally inner lower arms 56, 61 are rigidly interconnected by cross braces 66 and the laterally inner upper arms 58, 63 are rigidly interconnected by cross braces 67 and cross braces 68.

Figure 6:
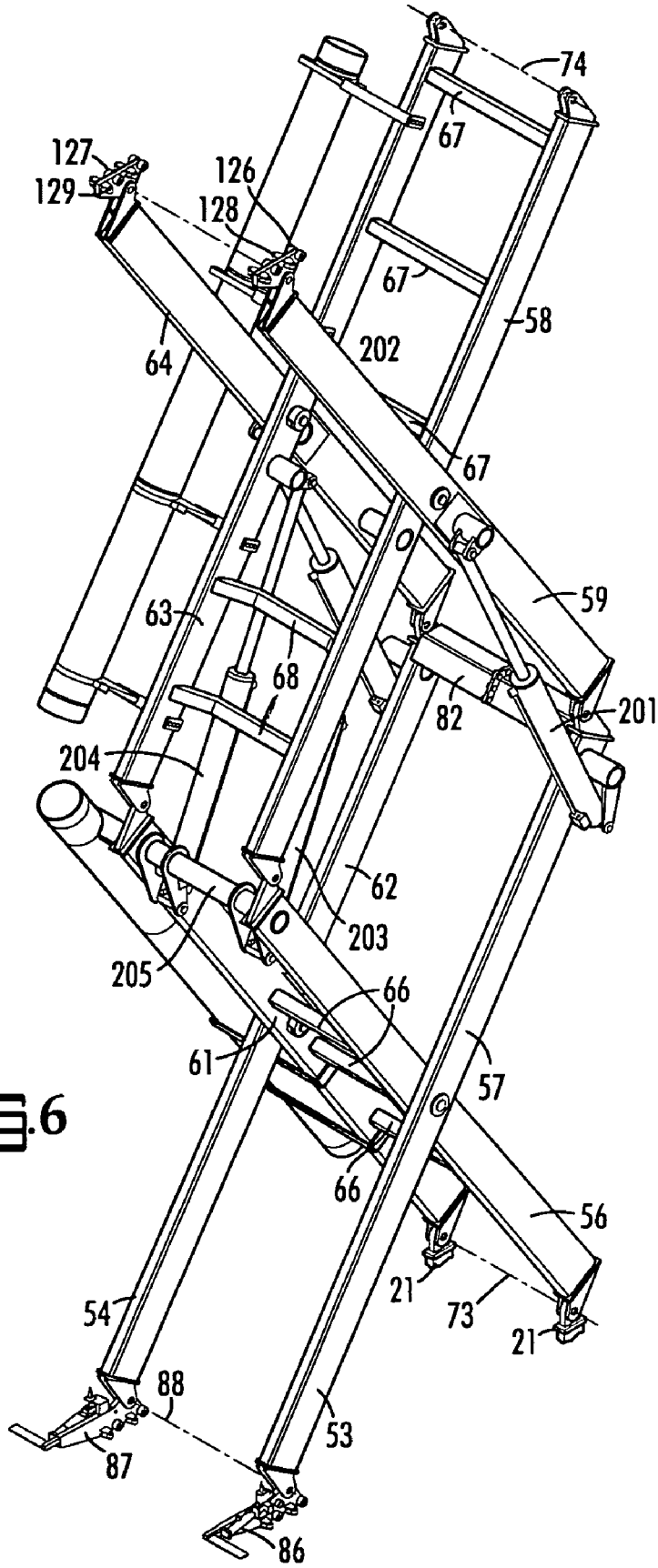
FIG. 6 is a perspective view of the double scissors linkages.
Figure 7:
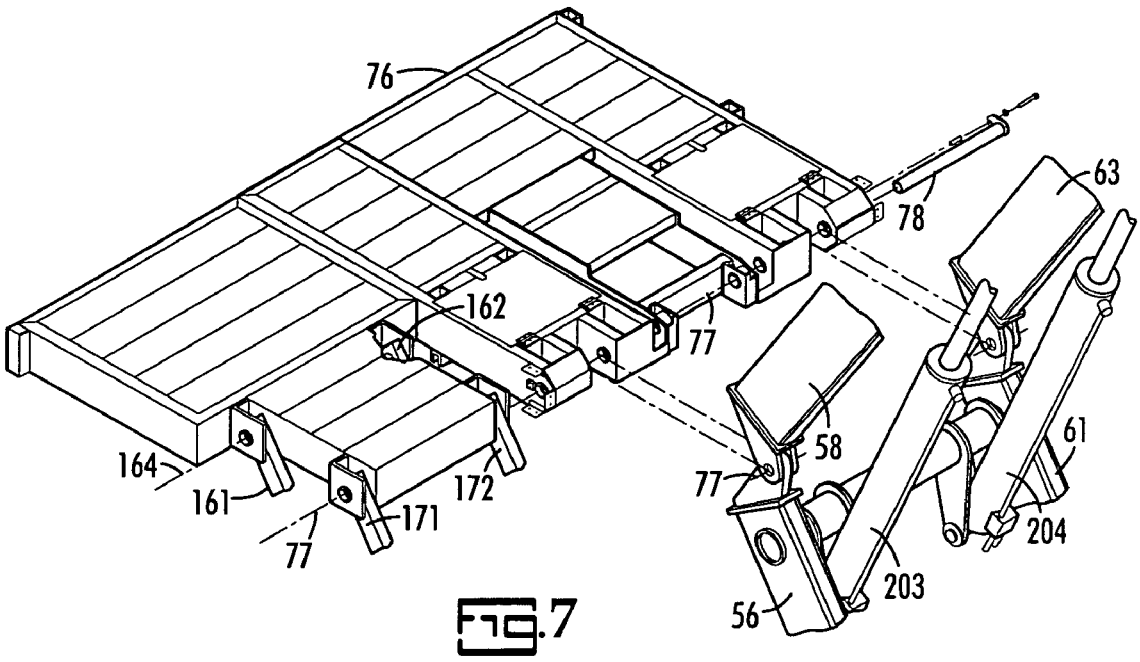
FIG. 7 is a perspective exploded view of the connection between the intermediate platform and the scissors linkages.
Figure 8:
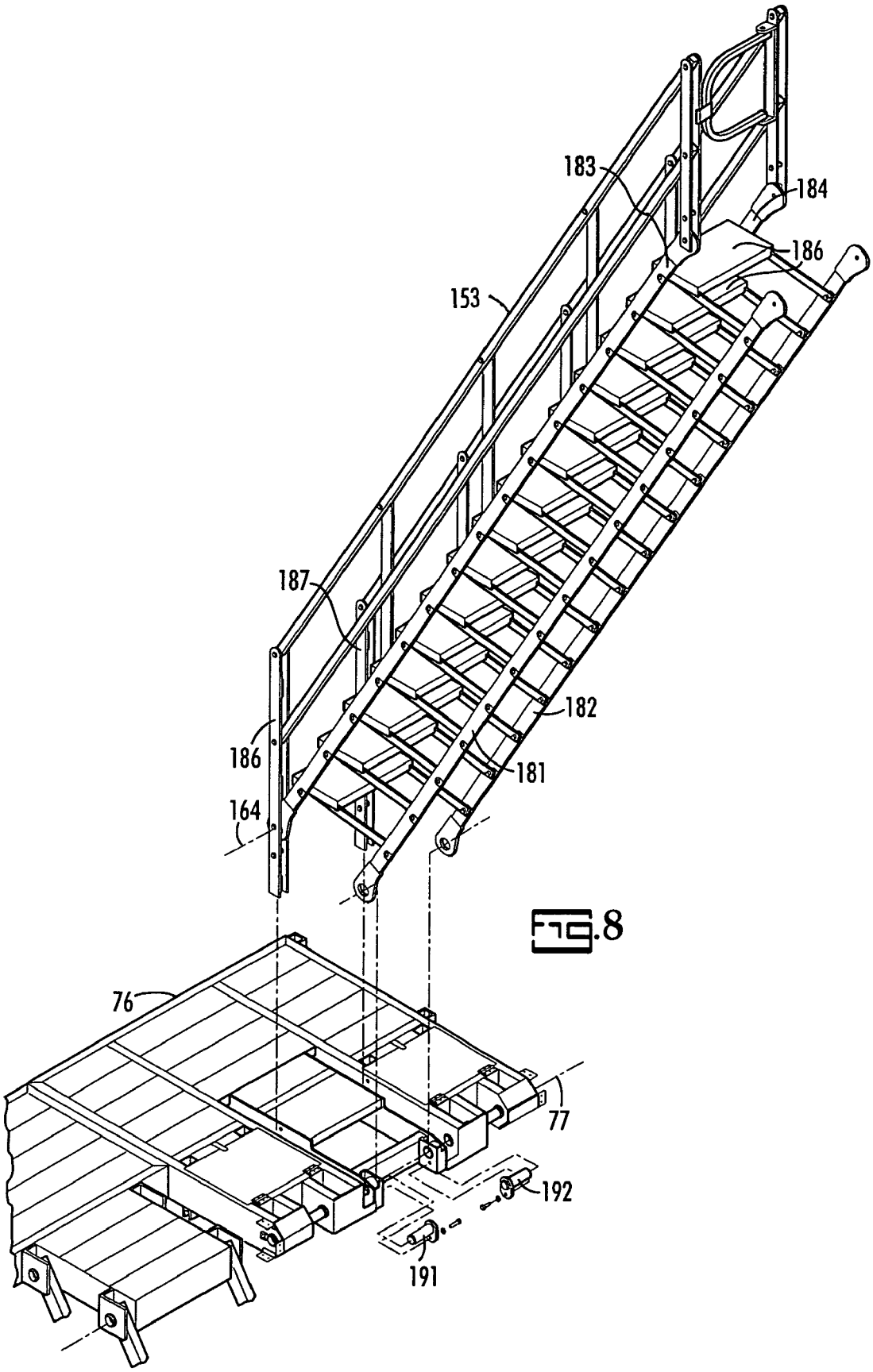
FIG. 8 is a perspective exploded view of the intermediate platform and the upper stairway.

The laterally inner lower arms 56, 61 are pivotally connected near their mid points to the laterally outer lower arms 57, 62 respectively, on a laterally extending horizontal axis 71. The laterally inner upper arms 58, 63 are pivotally connected near their mid point near the mid point of the laterally outer upper arms 59, 64, respectively, on a laterally extending horizontal axis 72. As shown in FIG. 6, the corresponding lower ends of the laterally inner lower arms 56, 61 are pivotally connected to the base frame 21 on a laterally extending horizontal axis 73. Corresponding upper ends of the laterally inner upper arms 58, 63 are pivotally connected to the upper platform support frame 52 on a laterally extending horizontal axis 74. The corresponding lower ends of the laterally inner upper arms 58, 67 are pivotally connected to the corresponding upper ends of the laterally inner lower arms 56, 62, respectively, and to an intermediate platform 76, as shown in FIG. 7, on a laterally extending horizontal axis 77 by a pair of pivot pins 78. The lower ends of the laterally outer upper arms 59, 64 are pivotally connected to the corresponding upper ends of the laterally outer lower arms 57, 62 on a laterally extending horizontal axis 81. The laterally outer upper arms 59, 64 are vertically aligned with the laterally outer lower arms 57, 62, respectively; and the laterally inner upper arms 58, 63 are vertically aligned with the laterally inner lower arms 56, 61, respectively. As shown in FIGS. 1, 2, 4 and 6, the upper ends of the laterally outer lower arms 57, 62 are rigidly interconnected by a transverse cross brace 82.

Figure 9:
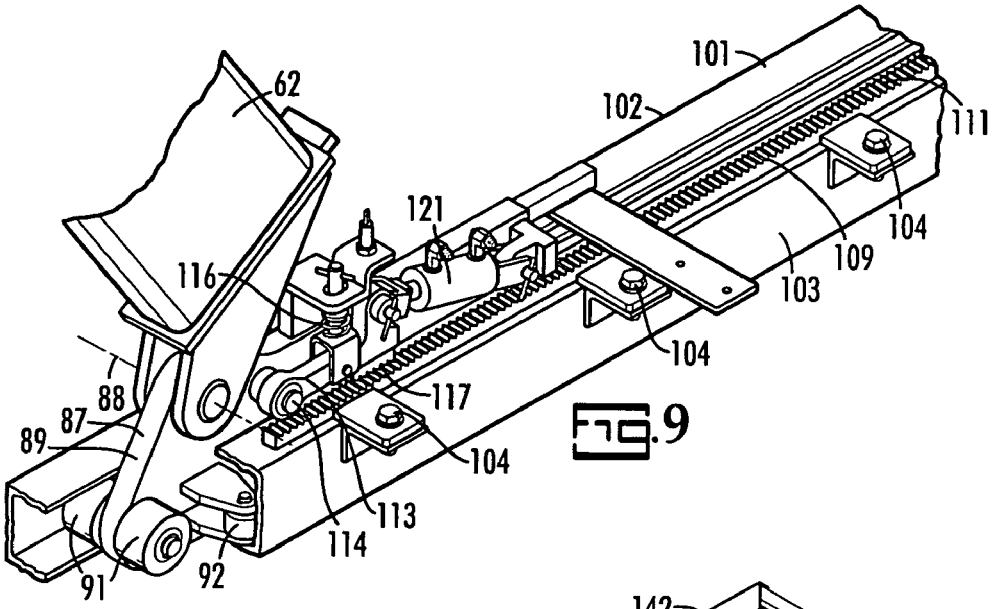
FIG. 9 is a perspective view of a left side lift lock.

As shown in FIG. 6, the lower ends of the laterally outer lower arms 57, 62 are pivotally connected, respectively, to a pair of trolleys 86, 87 on a laterally extending pivot axis 88. The trolleys 86, 87 are reverse images of one another. The right lower trolley 87, shown in FIG. 9, includes a mounting plate 89, support rollers 91, and side thrust rollers 92, only one of which is shown. The trolley 87 is supported by a front to rear extending horizontal trolley track 101 formed by two channels 102, 103 rigidly secured to the top of the right side of the base frame 21. In a like manner the trolley 86 is mounted in a trolley track 106 rigidly secured to the top of the left side of the base frame 21. The tracks 101, 106 and trolleys 86, 87 form track and follower connections between the laterally lower arms 57, 62 and the base frame 21. A horizontal rack 109 with upstanding teeth 111 is secured to the laterally outer channel 103 by suitable fasteners 104. The trolley 87 includes a lift lock pawl 113 pivotally mounted on the plate 89 by a laterally extending pivot pin 114. The pawl 113 is biased downwardly by a compression coil spring 116 whereby its teeth 117 engage the teeth of the rack 109 thereby locking the trolley 87 to the track 101. A linear fluid actuator in the form of a double acting hydraulic ram 121 has its cylinder end pivotally connected to the plate 89 of the trolley 87 and its rod end pivotally connected to the pawl 113. The trolley 86 is a reverse image of trolley 87.

Figure 10:
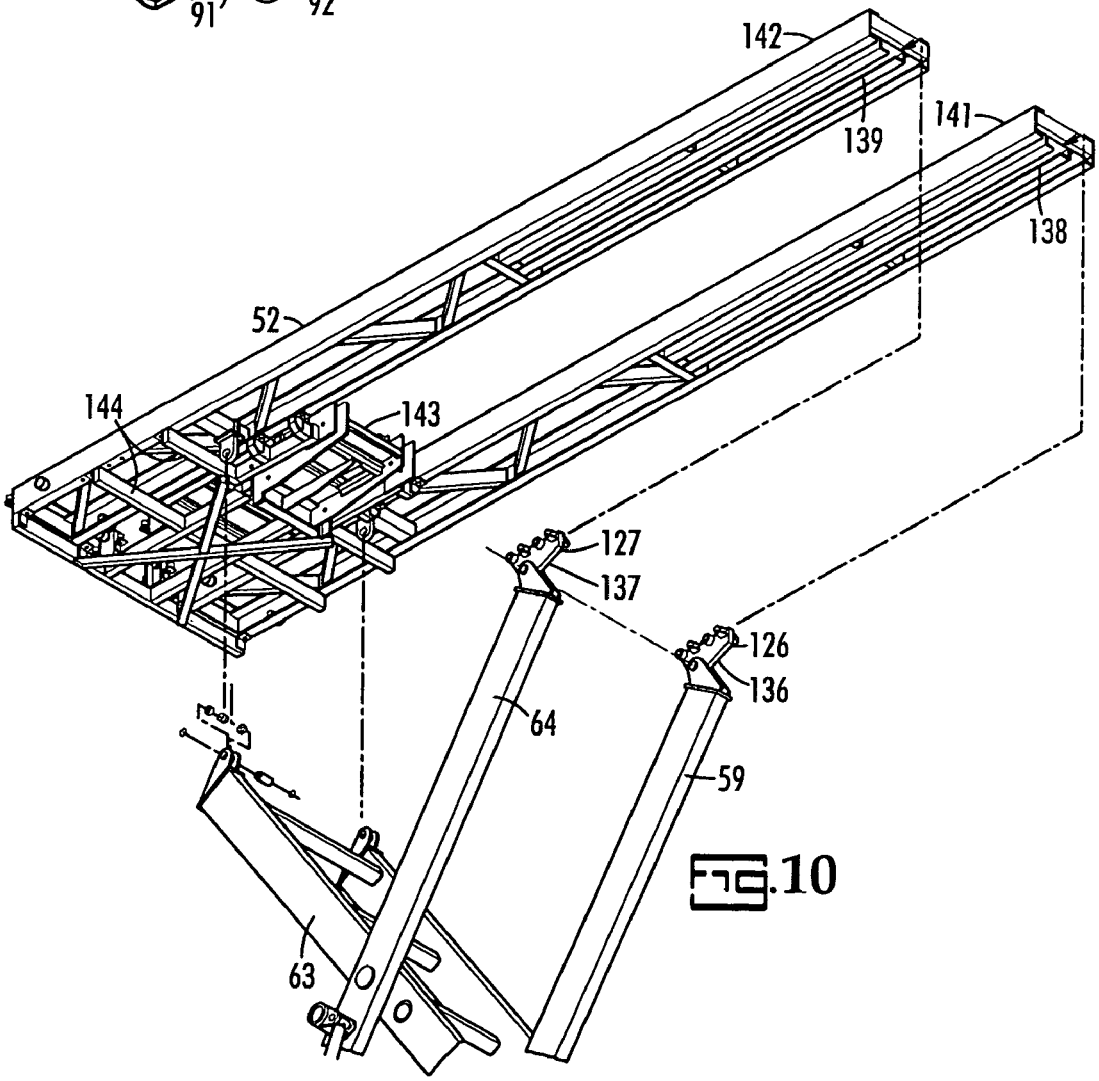
FIG. 10 is an exploded perspective view of the under side of the upper platform support frame and its connection to the upper arms of the scissors linkages.
Figure 11A:
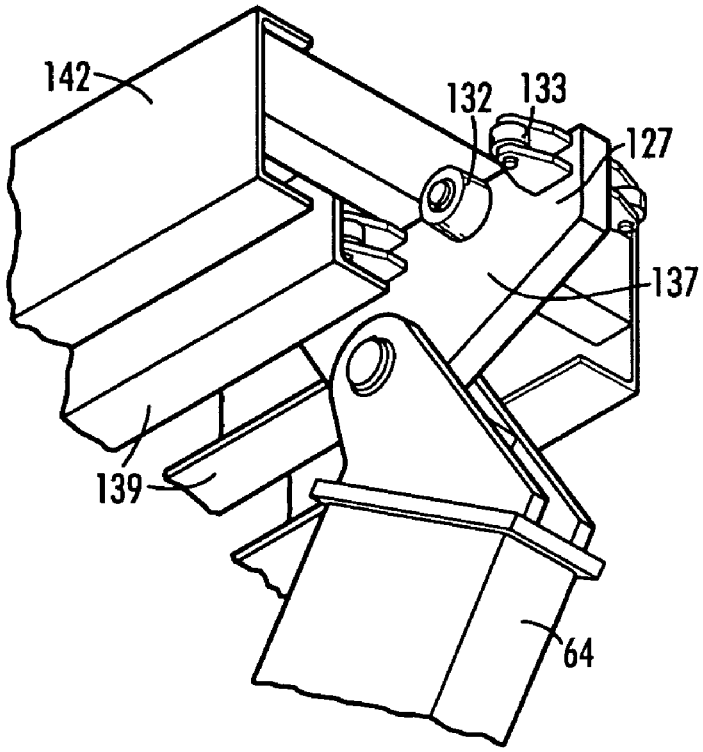
FIG. 11A is a perspective view showing a trolley being inserted into a track on the underside of the upper platform support frame.
Figure 11B:
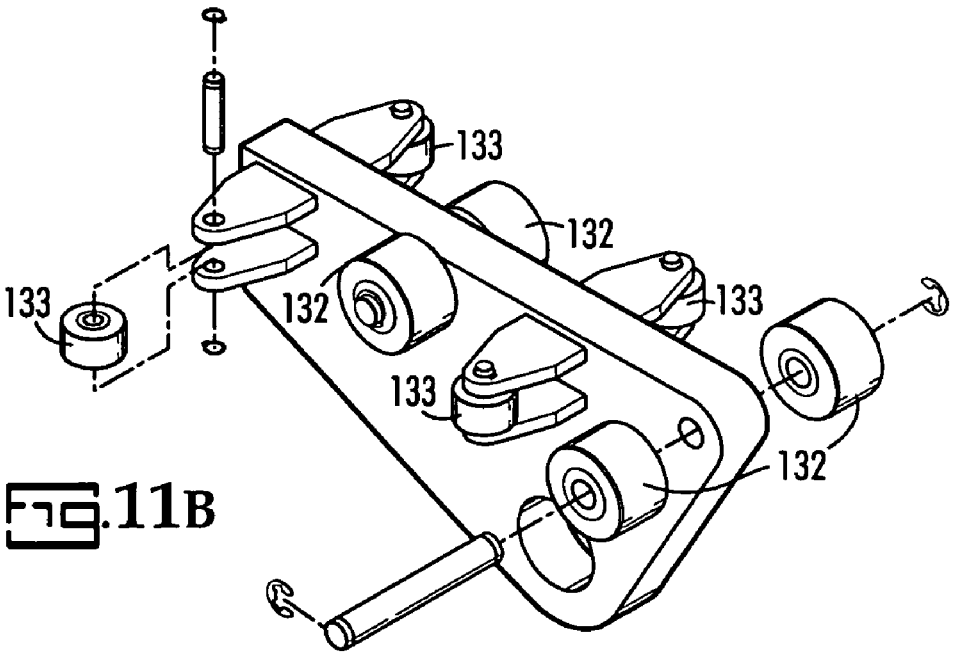
FIG. 11B is an exploded perspective view of the trolley shown in FIG. 11A.

As shown in FIGS. 6, 10 and 11A a pair of trolleys 126, 127 have plates 128, 129 pivotally connected, respectively, to the upper ends of the laterally outer upper arms 59, 64 on a laterally extending horizontal axis 131. Track rollers 132 and side thrust rollers 133 pivotally mounted on the plates 136, 137 of the trolleys 126, 127 engage of pair horizontal parallel trolley tracks 138, 139 formed on the underside of pair of parallel, laterally spaced elongated fore and aft extending platform support sections 141, 142 of the upper platform support frame 52. The support sections 141, 142 are rigidly interconnected by a central section 143.

A removable access platform or side landing module 144 is rigidly secured to the left side of the base frame 21, near its rear end, by releasable fasteners, not shown. The access platform 144 includes a deck 145, a fixed staircase 146 and a forwardly projecting part 147 of the deck 145 disposed laterally between the staircase 146 and the base frame 21. A wheel 148 is swivel mounted to the underside of the staircase 146.

A two-part self-leveling step staircase 151 is provided between the forwardly projecting part 147 of the access platform 144 and the central section 143 of the upper platform support frame 52. The staircase 151 includes a first self leveling step stairway or flight 152 interconnected between the forwardly projecting part 147 and the intermediate platform 76 and a second self leveling step stairway or flight 153, between the intermediate landing 76 and the central section 143 of the upper platform support frame 52. The first stairway 152, which is disposed on the left side of the maintenance stand, includes a pair of parallel lower tread stringers 161, 162 pivotally connected at their lower ends on a laterally extending horizontal axis 163 to the forward projecting part 147 of the access platform deck 145. As shown in FIG. 7 the upper ends of the lower tread stringers 161, 162 are pivotally connected to the intermediate platform 76 on a laterally extending horizontal pivot axis 164. The lower or first stairway 152 also includes a pair of laterally spaced parallel upper tread stringers 171, 172. A plurality of tread assemblies 176 are pivotally connected to the upper and lower tread stringers 161, 162, 171, 172. The upper ends of the upper tread stringers 171, 172 are pivotally connected to the intermediate platform 76 on axis 77 and the lower ends of the upper tread stringers are pivotally connected to the forward projecting part 147 of the access platform deck 145 thus completing a parallel linkage arrangement of the lower stairway 152.

Figure 1:
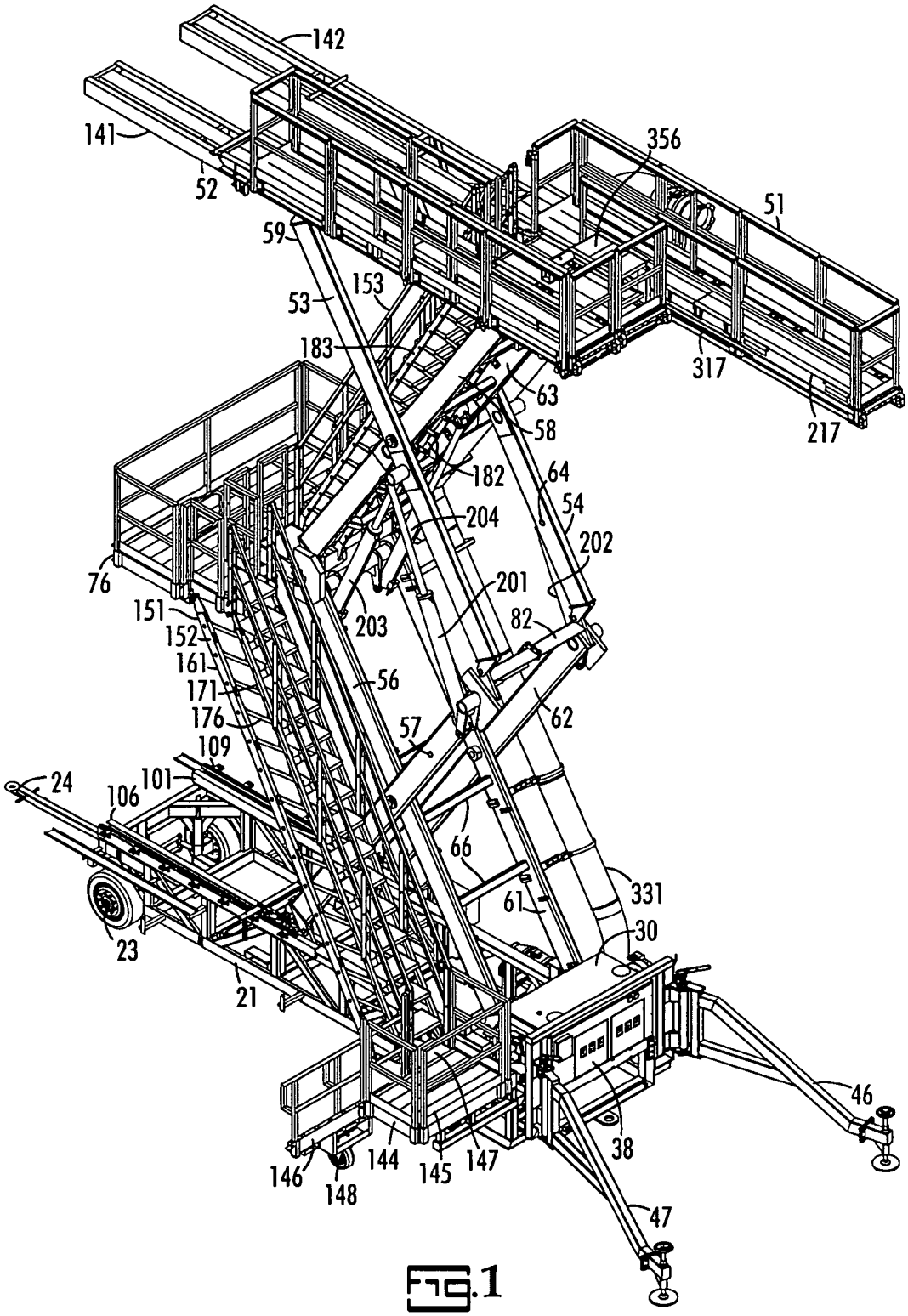
FIG. 1 is a perspective view from the left rear of the maintenance stand.
Figure 2:
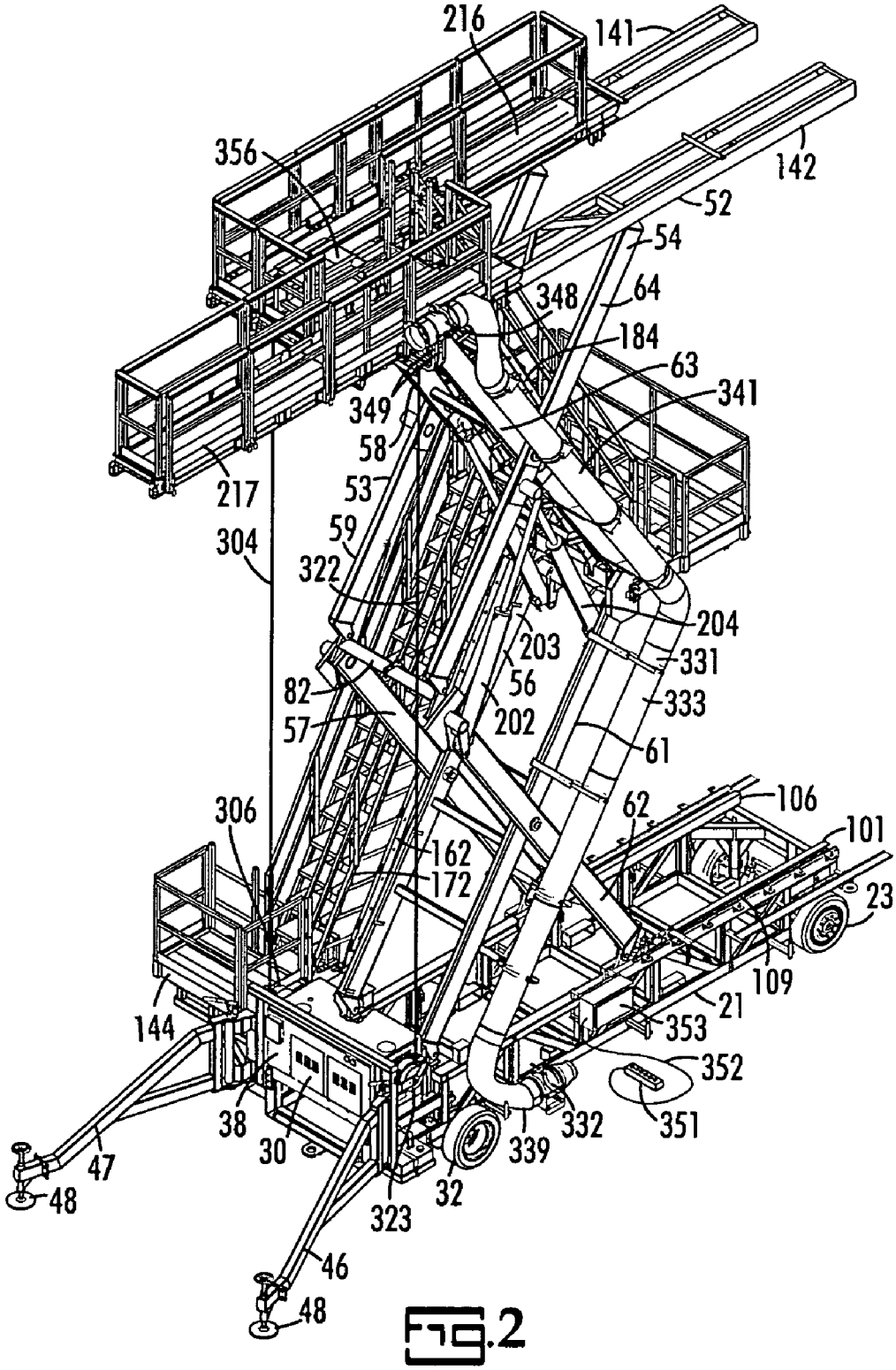
FIG. 2 is a perspective view from the right rear of the maintenance stand with the tow bar removed.
Figure 3:
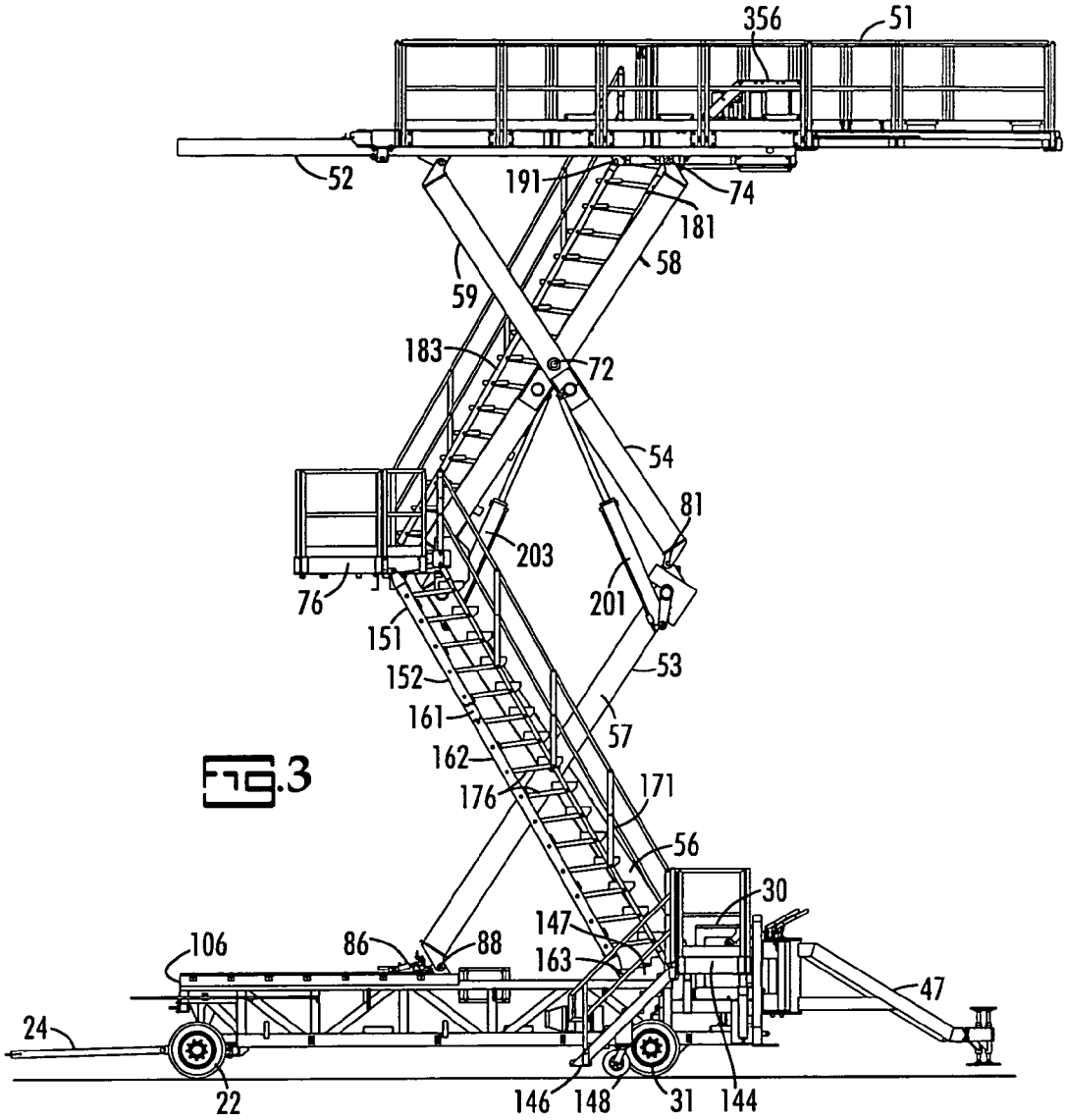
FIG. 3 is a left side view of the maintenance stand.
Figure 4:
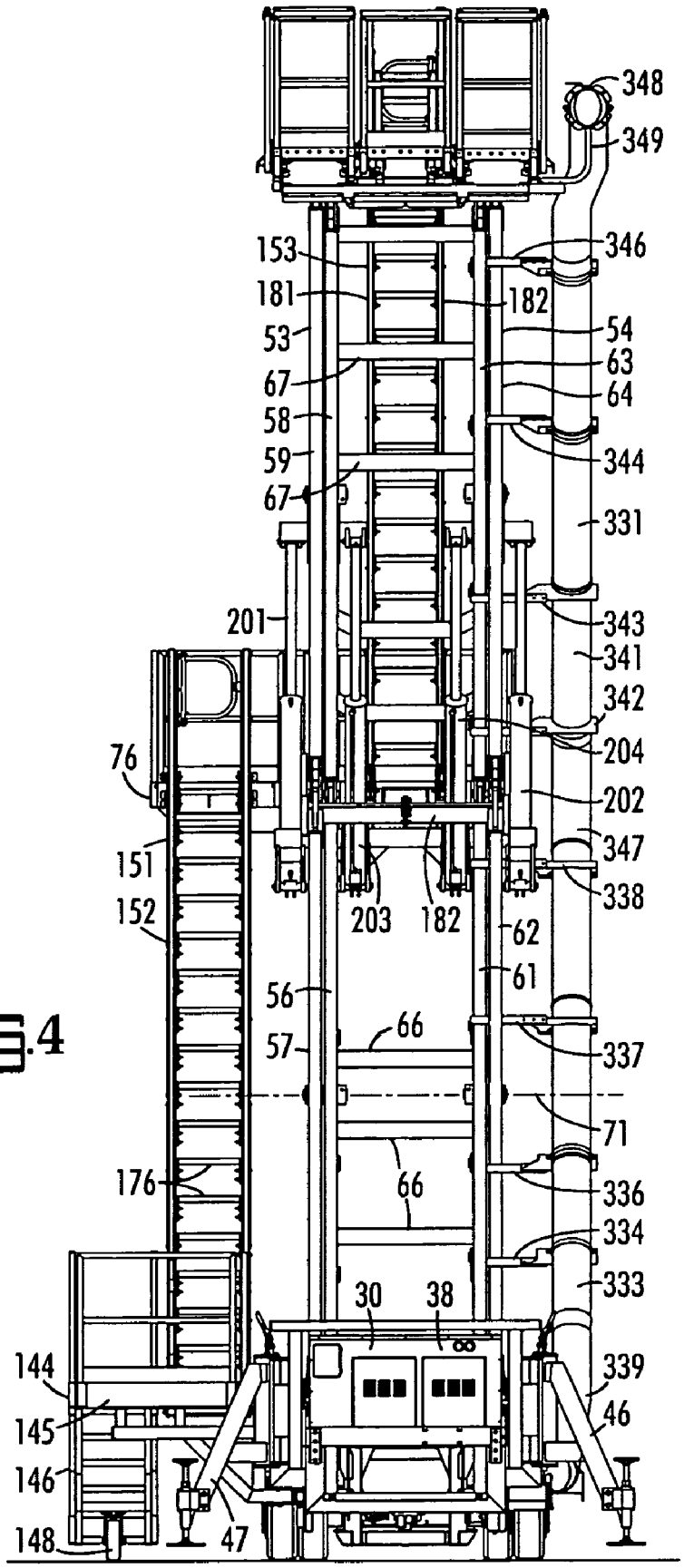
FIG. 4 is a rear view of the maintenance stand.

As shown in FIGS. 1, 2, 3, 4 and 8, the upper stairway 153 includes a pair of parallel lower tread stringers 181, 182 and a pair of parallel upper tread stringers 183, 184 with a plurality of tread assemblies 186 pivotally connected to the stringers 181, 182, 183, 184. The lower ends of the lower stringers 181, 182 are pivotally connected by pins 191, 192, respectively, to the intermediate platform 76 on pivot axis 77 and the lower ends of the upper tread stringers 183, 184 are pivotally connected to the intermediate platform 76 and to upright hand rail posts 186, 187, respectively on the laterally extending horizontal axis 164. The handrail posts 186, 187 are rigidly secured to the intermediate platform 76 by releasable fasteners, not shown. As shown in FIG. 3, the upper ends of the lower tread stringers 181, 182 are pivotally connected to the upper platform support frame 52 on transverse axis 74, and the upper ends of the upper tread stringers, 183, 184 are pivotally connected to the upper platform support frame 52 on a transverse axis 191. Appropriate guardrails are provided for the stairways 152, 153 and the access staircase 145. Also, appropriate removable guardrails are provided for the access platform 144, the intermediate platform 76 and the upper platform 51.

The upper worker platform 51 is raised and lowered by the two double scissors linkages 53, 54 through extension and contraction of four fluid powered linear actuators 201, 202, 203 and 204 in the form of double acting hydraulic rams each having a piston and a cylinder. The actuators 201 and 202 have rod ends pivotally connected to the laterally outer upper arms 59, 64, respectively, and their cylinder ends pivotally connected to the laterally outer lower arms 57, 62 respectively. The actuators 203, 204 have their rod ends pivotally connected to the laterally inner upper arms 58, 63, respectively, and their cylinder ends pivotally connected to the laterally inner lower arms 56, 61 through a cross brace 205, shown in FIG. 6. The actuators are operated through a fluid control system such as shown in FIG. 22, which includes a solenoid operated control valve 210 having raise, lower and hold positions of adjustment. A flow divider 221 provides uniform extensions and contraction of actuators 203, 204 and a flow divider 212 provides uniform extension and contraction of the actuators 203, 204.

Figure 12:
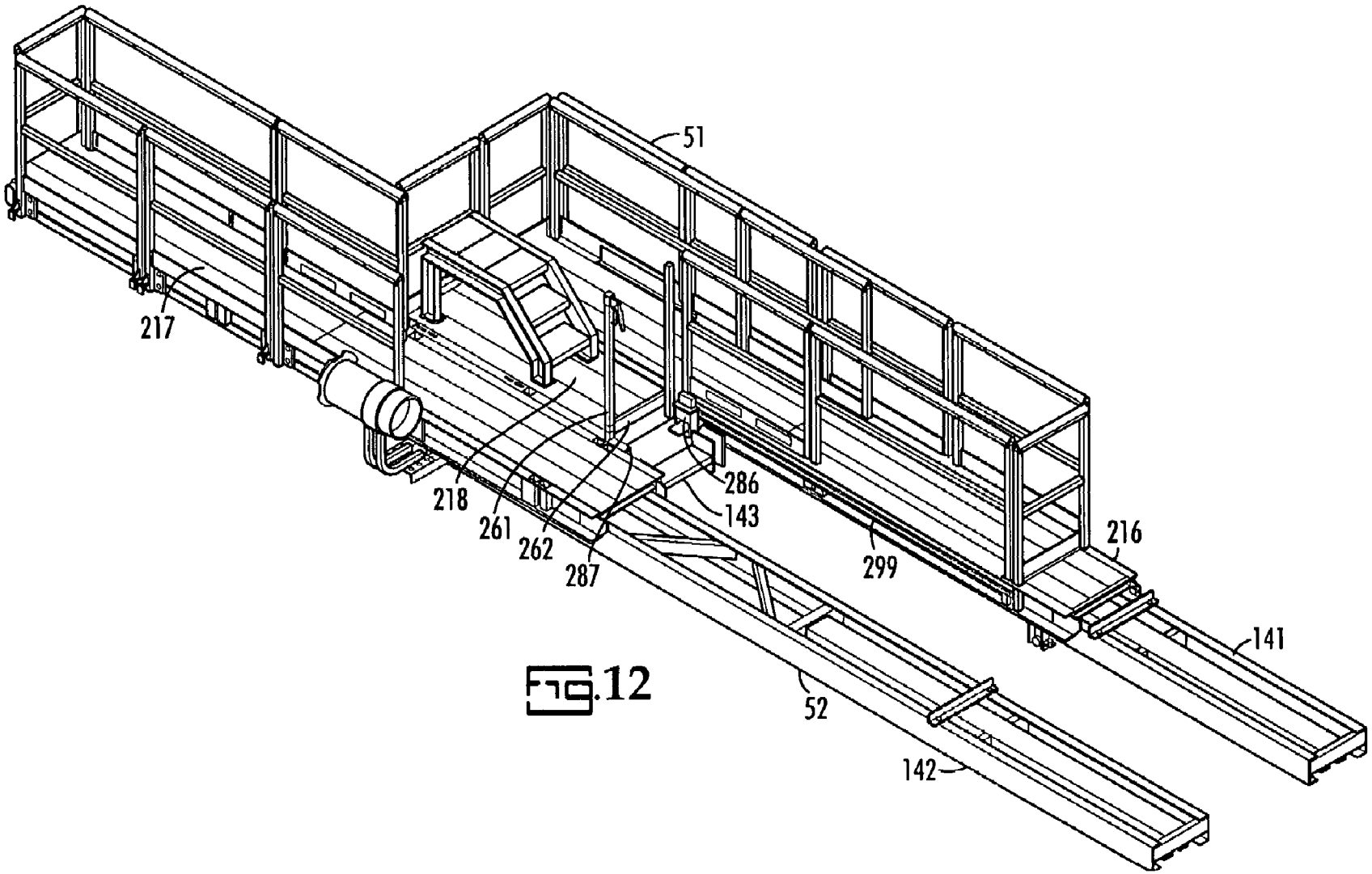
FIG. 12 is a perspective view of the upper platforms and their support frame.
Figure 13:
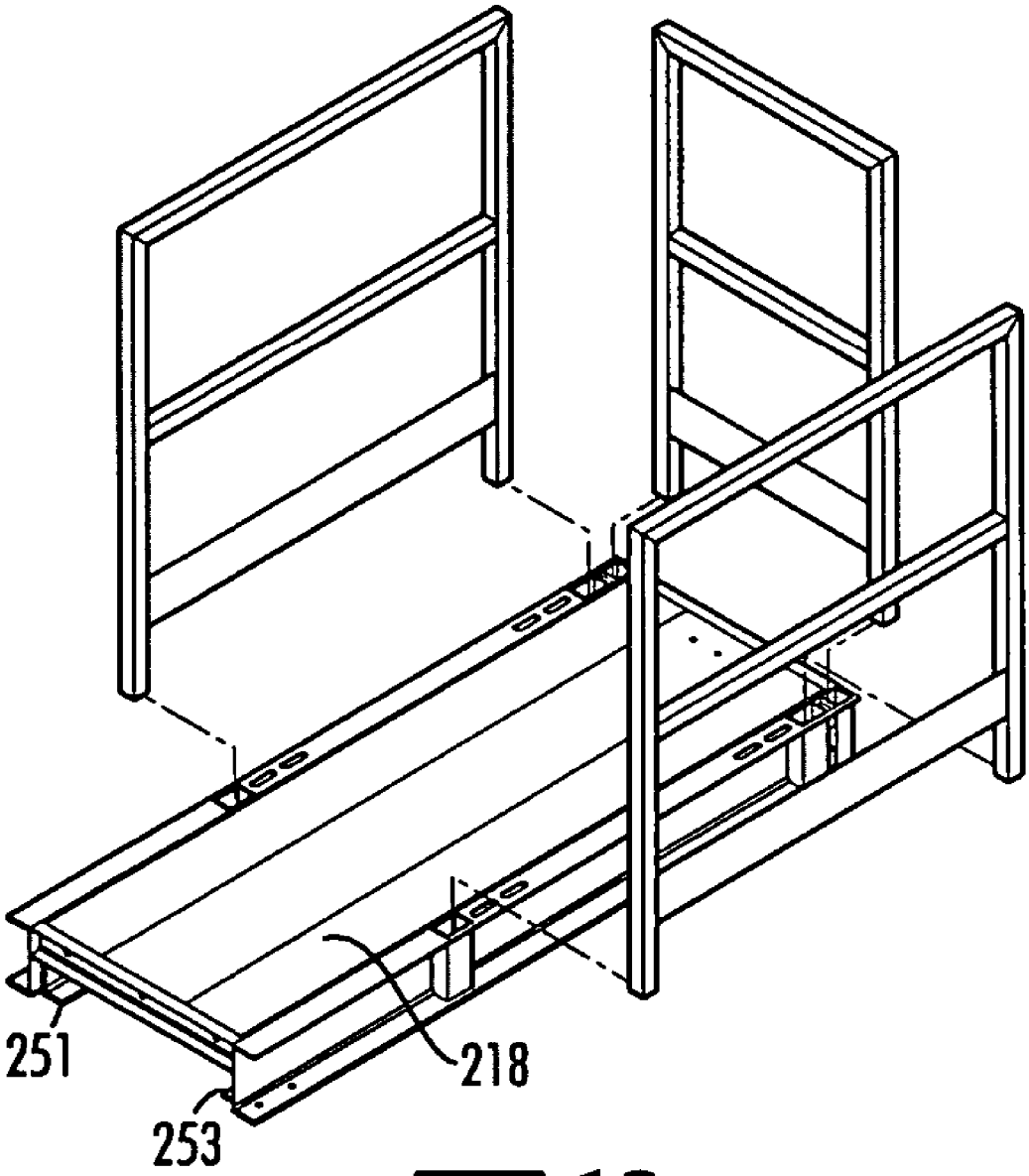
FIG. 13 is an exploded perspective view of the rolling center platform.
Figure 20:
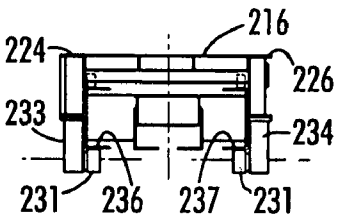
FIG. 20 is a section taken on line 20-20 in FIG. 18.
Figure 19:
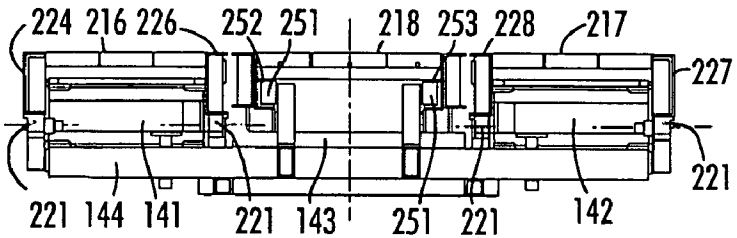
FIG. 19 is a section taken on line 19-19 in FIG. 18.
Figure 21:
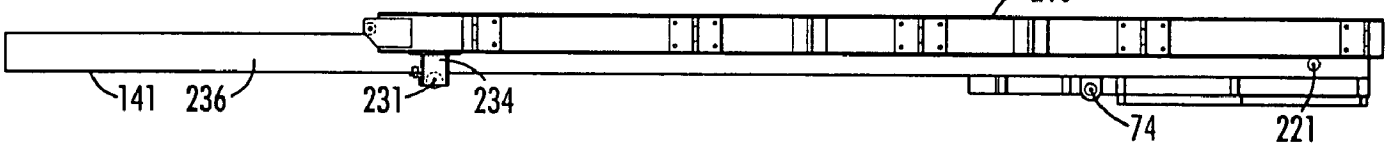
FIG. 21 is a left side view of the upper worker platform shown in FIG. 18.

Referring to FIGS. 5, 10, 12, 13, 18, 19, 20 and 21, the upper worker platform support frame 52 of the upper platform assembly 51 includes the laterally spaced and horizontally elongated left and right spaced support sections 141, 142 rigidly interconnected by the central section 143. An elongated horizontally shiftable worker platform 216 is mounted on the left support section 141. An elongated horizontally shiftable worker platform 217 is mounted on the right support section 142 and a horizontally shiftable central worker platform 218 is mounted on the central support section 143. As shown in FIG. 19, rollers 221 mounted on the rear parts of the support frames 141, 142 provide vertical support for side channels 224, 226 of the left rolling platform 216 and for side channels 227, 228 of the right rolling platform 217. As shown in FIG. 20 and 21, rollers 231 mounted on channels 224, 226 by brackets 233, 234 engage the undersides of channels 236, 237 of support section 141. The forward end of the rolling right platform 217 is stabilized in a similar manner by a pair of rollers. The rolling center platform 218 is supported by rollers 251 mounted on the central support section 143. The rollers 251 run in fore and aft extending channels 252, 253 on the under side of the rolling center platform 218. The channels 252, 253 are also shown in FIG. 13.

Figure 14:
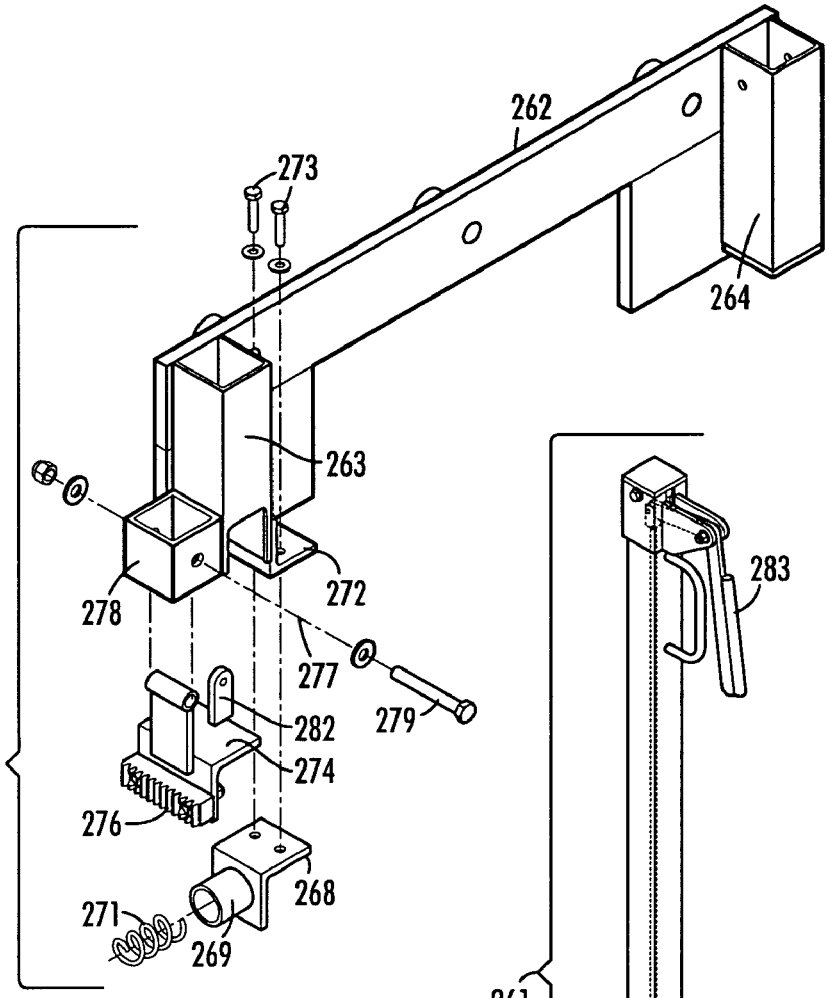
FIG. 14 is an exploded perspective view of a center platform brake support structure and brake components.
Figure 15:
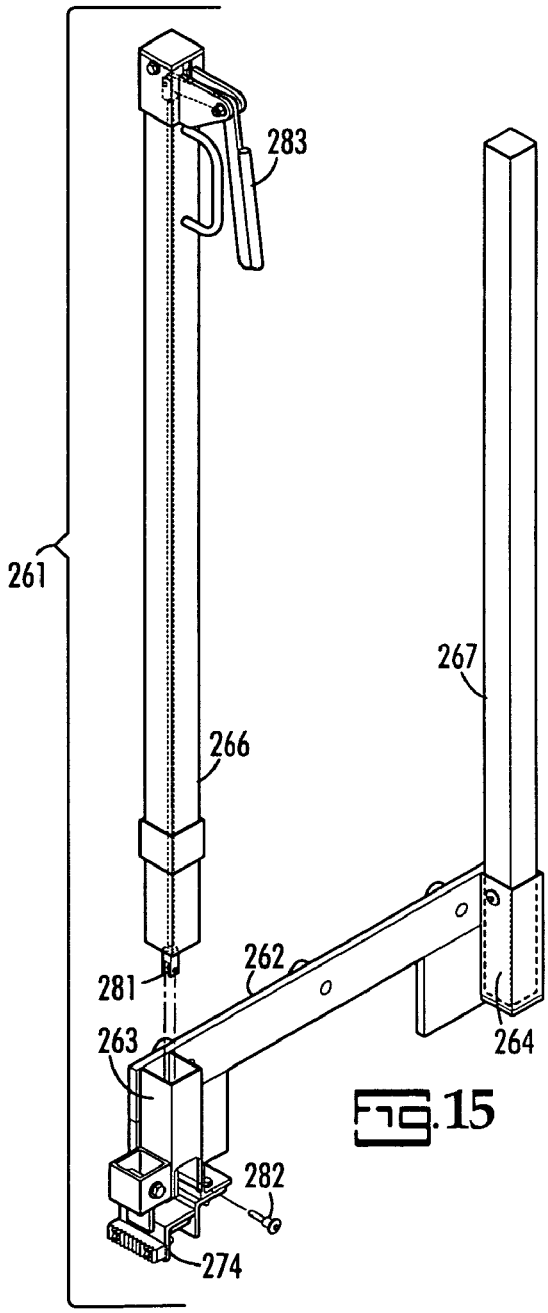
FIG. 15 is an exploded perspective view of the hand operated center platform brake and its support structure.

A spring loaded manually releasable brake mechanism 261 for the center-rolling platform 218 is shown in FIGS. 12, 14 and 15. A center platform brake mount 262 is rigidly secured to the forward end of the rolling center platform 218. The brake mount 262 includes a pair of sockets 263, 264 adapted to receive hollow posts 266, 267. A brake spring holder 268 with a cylindrical pocket 269 for a coil compression brake spring 271 is secured to an angle bracket 272 welded to lower end of the socket 263 by releasable fasteners in the form of bolts 273 and nuts, not shown. A brake lever 274 with a brake pawl 276 is pivotally mounted by a pivot pin 279 on a front to rear extending horizontal axis 277 to a box shaped bracket 278 welded to the right side of the socket 263. In the installed condition of the brake lever 274, a lower end of a vertical brake rod 281 is pivotally connected to a tab 282 on the brake lever 274 by a pivot pin 282. The brake rod 281 is operated by a hand operated brake release lever 283 pivotally connected to the top of the post 266. The lever 283 has an arm pivotally connected to the upper end of the brake rod 281. The pawl 276 engages a front to rear extending rack, not shown, on the upper platform support frame 52.

Figure 16:
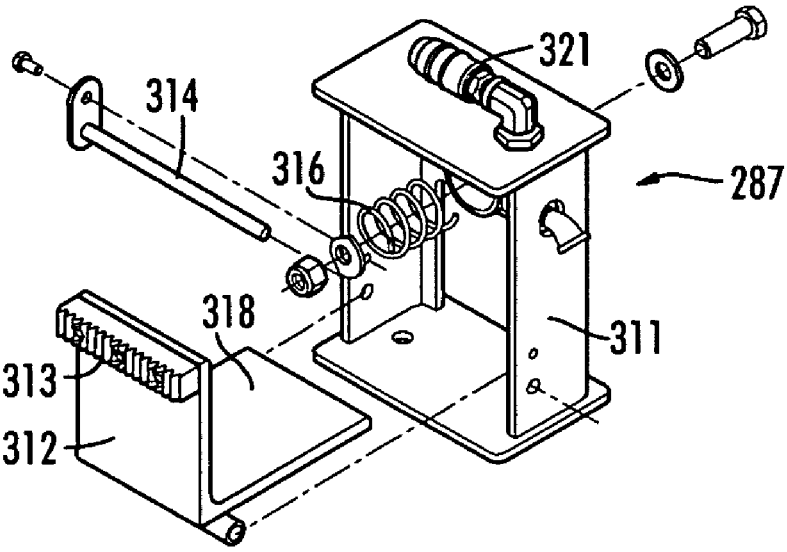
FIG. 16 is an exploded perspective view of a foot-operated brake for the right upper rolling platform.
Figure 17:
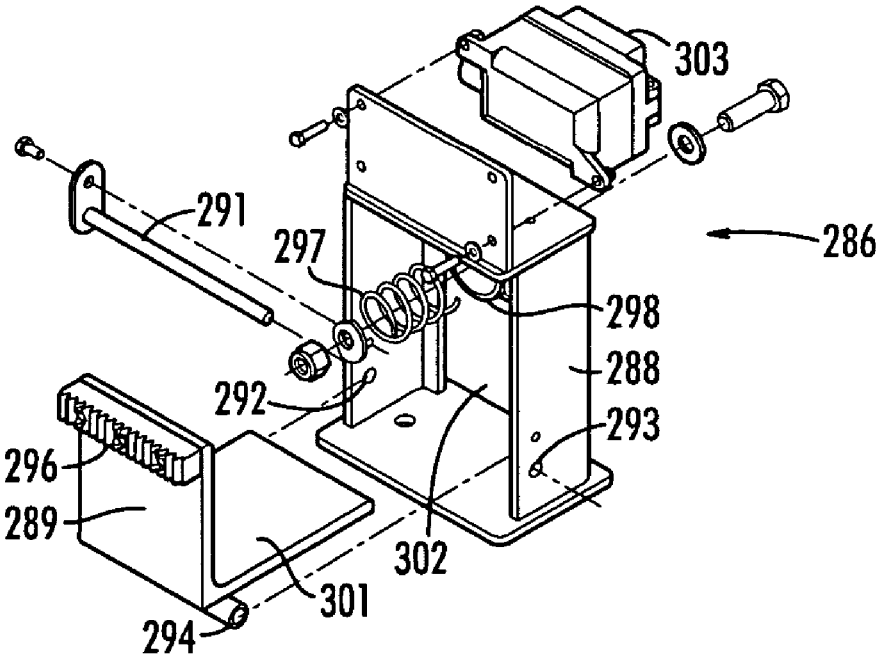
FIG. 17 is an exploded perspective view of a foot-operated brake for the left upper rolling platform.
Figure 18:
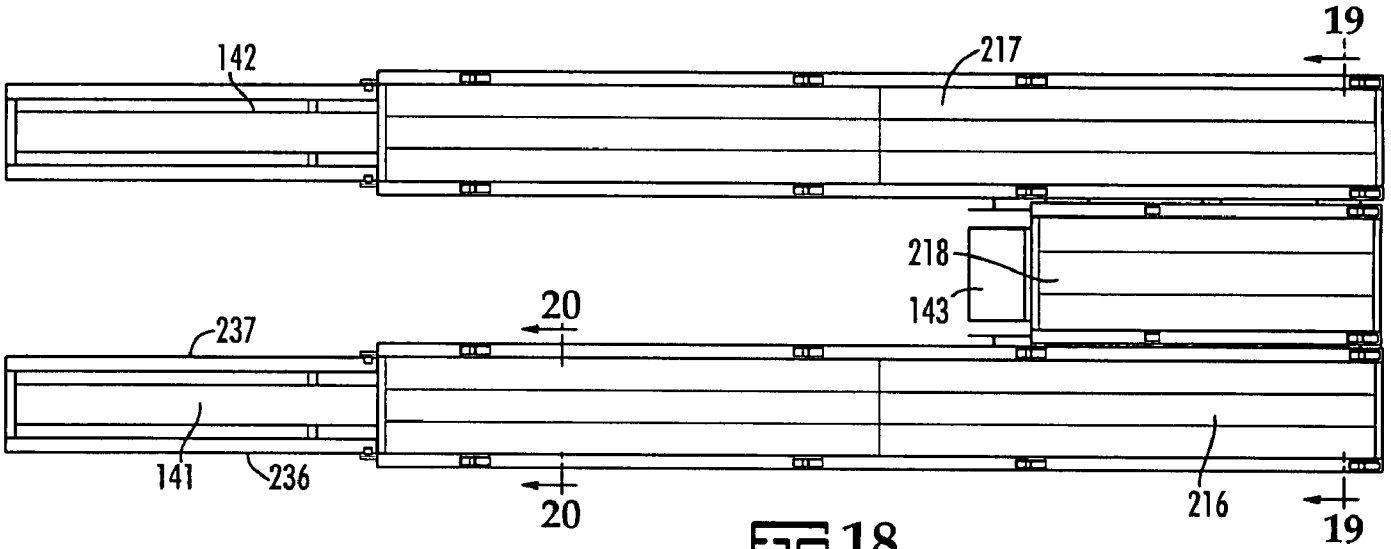
FIG. 18 is a top view of the upper rolling platforms and their support frame.

As shown in FIG. 12, a pair of foot release spring loaded brakes 286, 287 for the left and right rolling upper platforms 216, 217 are mounted on the center section 143 of the upper platform support frame 52. The left brake 286, as shown in FIG. 17, includes a housing 288 to which a brake lever 289 is pivotally connected by a pin 291 which, when installed, extends through openings 292, 293 in the housing and an opening 294 in the brake lever 289. A pawl 296 is secured to the brake lever 289 and a coil compression spring 297, which loosely fits in a cylindrical part 298, biases the pawl 296 toward an engaged position in which it engages a rack 299 secured to the right side of the left rolling platform 216. The horizontally extending portion 301 of the brake lever 289 extends through an opening 302 in the housing and may be engaged by a workers foot to disengage the brake 286. The brake housing 288 serves as a convenient support for a female electrical outlet 303 connected to an electric line 304, shown in FIG. 2, extending upward from an electric line reel 306 mounted on the base frame 21. The right foot operated brake 287, shown in FIG. 16 mounted on the center section 143, includes a housing 311, a brake lever 312 with a rack 313, a pivot pin 314 and a coil compression spring 316 which biases the brake lever 312 to a brake engaging position in which the rack 313 engages a front to rear extending rack 317 secured to the laterally inner side of the right rolling platform 217, as shown in FIG. 1. The L-shaped brake lever 312 includes a horizontally extending portion 318, which can be engaged by the foot of a worker to release the brake. The housing 311 of the brake for the right rolling worker platform 217 serves as a support for a quick disconnect coupler 321 at the end of a compressed air hose 322 extending up from a hose reel 323 mounted on the base frame 21, as shown in FIG. 2.

In addition to equipment supplying electricity and compressed air to the worker platform 51, cooling air is supplied to the platform 51 by a duct 331, shown in FIGS. 1, 2, 4 and 5 which includes a rigid duct section 332 mounted on the base frame 21, a rigid duct section 333 secured to the right laterally inner lower arm 61 of the scissor linkage 54 by brackets 334, 336, 337, 338, a flexible duct section 339 interconnecting ducts 332 and 333, a rigid duct section 341 secured to the laterally inner upper arms 63 of the scissor linkage 54 by brackets 342, 343, 344, 346, a flexible duct section 347 interconnecting rigid duct sections 333 and 341, a rigid duct section 348 secured to right section 142 of the upper platform support frame 52 by brackets 349 and a flexible duct section interconnecting the rigid duct section 348 and the rigid duct section 341.

The power module 30 can be controlled through a control including a hand pendant 351 on a flexible cable 352 connected to an electric control panel 353, which in turn is connected to the power module 30 and the solenoid valves. The hand pendant 351 allows an operator to view all movements of the stand from either front, rear or side positions. While standing on the ground, the operator drives the stand to the intended position at the aircraft, extends and locks the outriggers 46, 47 in place and raises the platform 51 to the desired height. The operator then climbs the stairs to upper central platform section and extends the rolling platforms to the desired position.

The mobile maintenance stand is designed for efficient service of large airplanes and helicopters. Its large size gives rise to the need to provide motive power to move it from storage to aircraft servicing positions. A portable worker stand 356, shown in FIGS. 1, 2, 3, 4 and 5, may be positioned on the central worker platform 218 to give the worker additional working height.

What is claimed is:

1. A maintenance stand comprising:

a horizontally elongated wheeled base frame having a front end, a rear end and laterally opposite sides, a horizontally elongated upper worker platform assembly including an upper platform support frame in parallel relation to said base frame, first and second laterally spaced double scissors linkages interconnected between said base frame and said upper platform support frame, each of said double scissors linkages being adjustable between a low collapsed position and a vertically extended position and each including a laterally outer lower arm, a laterally inner lower arm pivotally connected at its midpoint to a midpoint of said laterally outer lower arm on a first laterally extending horizontal axis, a laterally outer upper arm, a laterally inner upper arm pivotally connected at its midpoint to a midpoint of said laterally outer upper arm on a second laterally extending horizontal axis, first corresponding ends of said laterally inner lower arms being pivotally connected to said base frame on a third laterally extending horizontal axis, and transverse braces between said laterally inner lower arms and said laterally inner upper arms, first corresponding ends of said laterally inner upper arms being pivotally connected to said upper platform support frame on a fourth laterally extending horizontal axis, second corresponding ends of said laterally inner lower arms being pivotally connected, respectively, to second corresponding ends of said laterally inner upper arms on a fifth laterally extending horizontal axis, first corresponding ends of said laterally outer lower arms being pivotally connected, respectively, to first corresponding ends of said laterally outer upper arms on a sixth laterally extending horizontal axis, a first pair of track and follower connections between said base frame and second corresponding ends of said laterally outer lower arms, a second pair of track and follower connections between said upper platform support frame and second corresponding ends of said laterally outer upper arms, an intermediate platform pivotally connected to said second corresponding ends of said laterally inner lower arms and to said second corresponding ends of said laterally inner upper arms on said fifth laterally extending horizontal axis, a first self leveling step stairway interconnected between said upper platform support frame and said intermediate platform, a second self leveling step stairway interconnected between said base frame and said intermediate platform, and power means operable to move said double scissors linkages between said low collapsed position and said vertically extended position.

2. The maintenance stand of claim 1 wherein said laterally outer upper arms are vertically aligned with said laterally outer lower arms and wherein said laterally inner upper arms are vertically aligned with said laterally inner lower arms.

3. The maintenance stand of claim 1 wherein each of said double scissors linkages includes a fluid actuator interconnected between its laterally outer upper arm and its laterally outer lower arm and a fluid actuator interconnected between its laterally inner upper arm and its laterally inner lower arm.

4. The maintenance stand of claim 1 including pair of laterally spaced wheels at each of said front and rear ends.

5. The maintenance stand of claim 4 including a side landing module having a platform releasably secured to said base frame, said side landing module including a flight of steps affording ground level access to said platform and said side landing module providing access to said second stairway.

6. The maintenance stand of claim 5 wherein said side landing module includes a ground engageable support wheel.

7. The maintenance stand of claim 4 wherein said power means includes linear acting fluid actuators interconnected between said upper and lower arms of each of said scissors linkages and further comprising a power module on its rear end including an internal combustion engine, a fluid pump connected in driven relation to said engine, said pump having a pressure fluid outlet, a fluid motor connected in driven relation to one of said rear wheels, a first fluid control system interconnecting said pressure fluid outlet of said pump and said fluid motor having forward, reverse and neutral positions of adjustment, a second fluid control system interconnecting said pressure fluid outlet of said pump and said fluid actuators having raise, lower and hold positions of adjustment

8. The maintenance stand of claim 7 having pendant control for said first and second fluid control systems.

9. The maintenance stand of claim 1 wherein each of said first pair of track and follower connections includes a trolley track secured to said base frame and a trolley pivotally connected to the associated laterally outer lower arm, said trolley including wheels engaging the associated track and wherein each of said second pair of track and follower connections includes a trolley track secured to said upper platform support frame and a trolley pivotally connected to the associated laterally outer upper arm, said trolley including wheels engaging the associated track.

10. The maintenance stand of claim 9 including a rack secured to said base frame adjacent and parallel to each of said tracks and a pawl on each of said trolleys connected to said laterally outer lower arms, said pawls being releasably engageable with the associated rack to lock the associated trolley against horizontal movement in its associated track.

11. The maintenance stand of claim 10 wherein said platform assembly includes a pair of laterally spaced elongated worker platforms shiftably mounted for fore and aft horizontal movement on and extending in the direction of elongation of said upper platform support frame and wherein said support frame includes a center section disposed between said worker platforms and adjacent to an end of said first stairway.

12. The maintenance stand of claim 11 having a pair of spring biased brake mechanisms mounted on said support frame releasably restraining said worker platforms. respectively, against horizontal movement.

13. The maintenance stand of claim 12 having an intermediate worker platform reciprocally mounted on said platform support frame for horizontal fore and aft shifting movement.

14. The maintenance stand of claim 13 having a spring biased brake mechanism mounted on said intermediate worker platform releasably restraining said intermediate worker platform against said horizontal fore and aft shifting movement.

15. The maintenance stand of claim 1 including an electric cable reel mounted on said base frame having an electric cable extending from said reel to said support frame.

16. The maintenance stand of claim 1 including a compressed air hose reel mounted on said base frame having an air hose extending from said air hose reel to said support frame.

17. A maintenance stand comprising:

a horizontally elongated wheeled base frame, a horizontally elongated upper worker platform assembly including a support frame in parallel relation to said base frame, first and second laterally spaced double scissors linkages interconnected between said base frame and said upper platform support frame, each of said double scissors linkages being adjustable between a low collapsed position and a vertically extended position and each including a laterally outer lower arm having first and second ends, a laterally inner lower arm having first and second ends, said laterally inner lower arm being pivotally connected at its midpoint to a mid point of said laterally outer lower arm on a first laterally extending horizontal axis, a laterally outer upper arm having first and second ends, a laterally inner upper arm having first and second ends, said laterally inner upper arm being pivotally connected at its midpoint to a mid point of said laterally outer upper arm on a second laterally extending horizontal axis, first corresponding ends of said laterally inner lower arms being pivotally connected to said base frame on a third laterally extending horizontal axis, first corresponding ends of said laterally inner upper arms being pivotally connected to said upper platform support frame on a fourth laterally extending horizontal axis, second corresponding ends of said laterally inner lower arms being pivotally connected, respectively, to second corresponding ends of said laterally inner upper arms on a fifth laterally extending horizontal axis, first corresponding ends of said laterally outer lower arms being pivotally connected, respectively, to first corresponding ends of said laterally outer upper arms on a laterally extending horizontal sixth axis, a track and follower connection between each of said second corresponding ends of said laterally outer lower arms and said base frame, a track and follower connection between each of said second ends of said outer upper arms and said upper platform support frame, and a self-leveling step staircase between said base frame and said upper platform support frame, and an intermediate platform pivotally connected to said laterally inner arms on said fifth axis and wherein said staircase includes upper and lower flights pivotally connected to said intermediate platform on said fifth axis.

18. The maintenance stand of claim 17 wherein at least one of said flights is positioned laterally between said double scissors linkages.

19. The maintenance stand of claim 18 wherein each of said flights includes a pair of upper tread stringers and a pair of lower tread stringers, said upper tread stringers of said lower flight and said lower tread stringers of said upper flight being pivotally connected to said intermediate platform on said fifth axis.

20. The maintenance stand of claim 18 wherein the other of said flights is positioned on the laterally outer side of one of said double scissors linkages.

21. The maintenance stand of claim 20 wherein said other flight is said lower flight.

22. A maintenance stand comprising:

a horizontally elongated wheeled base frame, a horizontally elongated upper worker platform assembly including a support frame in parallel relation to said base frame, first and second laterally spaced double scissors linkages interconnected between said base frame and said upper platform support frame, each of said double scissors linkages being adjustable between a low collapsed position and a vertically extended position and each including a laterally outer lower arm having first and second ends, a laterally inner lower arm having first and second ends, said laterally inner lower arm being pivotally connected at its midpoint to a mid point of said laterally outer lower arm on a first laterally extending horizontal axis, a laterally outer upper arm having first and second ends, a laterally inner upper arm having first and second ends, said laterally inner upper arm being pivotally connected at its midpoint to a mid point of said laterally outer upper arm on a second laterally extending horizontal axis, first corresponding ends of said laterally inner lower arms being pivotally connected to said base frame on a third laterally extending horizontal axis, first corresponding ends of said laterally inner upper arms being pivotally connected to said upper platform support frame on a fourth laterally extending horizontal axis, second corresponding ends of said laterally inner lower arms being pivotally connected, respectively, to second corresponding ends of said laterally inner upper arms on a fifth laterally extending horizontal axis, first corresponding ends of said laterally outer lower arms being pivotally connected, respectively, to first corresponding ends of said laterally outer upper arms on a laterally extending horizontal sixth axis, a track and follower connection between each of said second corresponding ends of said laterally outer lower arms and said base frame, a track and follower connection between each of said second ends of said outer upper arms and said upper platform support frame, a self-leveling step staircase between said base frame and said upper platform support frame and a cooling air duct extending between said base frame and said worker platform support frame including rigid tube sections secured, respectively, to said base frame, said worker platform support frame and said inner arms of one of said scissors linkages and flexible tube sections interconnecting said rigid tube sections adjacent said $2^{nd}$, $3^{rd}$ and $4^{th}$ axes.

23. A maintenance stand comprising:

a horizontally elongated wheeled base frame, a horizontally elongated upper worker platform assembly including a support frame in parallel relation to said base frame, first and second laterally spaced double scissors linkages interconnected between said base frame and said upper platform support frame, each of said double scissors linkages being adjustable between a low collapsed position and a vertically extended position and each including a laterally outer lower arm having first and second ends, a laterally inner lower arm having first and second ends, said laterally inner lower arm being pivotally connected at its midpoint to a mid point of said laterally outer lower arm on a first laterally extending horizontal axes, a laterally outer upper arm having first and second ends, a laterally inner upper arm having first and second ends, said laterally inner upper arm being pivotally connected at its midpoint to a mid point of said laterally outer upper arm on a second laterally extending horizontal axis, first corresponding ends of said laterally inner lower arms being pivotally connected to said base frame on a third laterally extending horizontal axis, first corresponding ends of said laterally inner upper arms being pivotally connected to said upper platform support frame on a fourth laterally extending horizontal axis, second corresponding ends of said laterally inner lower arms being pivotally connected, respectively, to second corresponding ends of said laterally inner upper arms on a fifth laterally extending horizontal axis, first corresponding ends of said laterally outer lower arms being pivotally connected, respectively, to first corresponding ends of said laterally outer upper arms on a laterally extending horizontal sixth axis, a track and follower connection between each of said second corresponding ends of said laterally outer lower arms and said base frame, a track and follower connection between each of said second ends of said outer upper arms and said upper platform support frame, an intermediate platform pivotally connected to said laterally inner arms (56, 58, 61, 63) on said fifth axis and a self-leveling step staircase between said base frame and said upper platform support frame including upper and lower flights pivotally connected to said intermediate platform on said fifth axis, one of said flights of said staircase being positioned laterally between said double scissors linkages.

24. The maintenance stand of claim 23 wherein the other of said flights of said staircase being positioned on the laterally outer side of one of said double scissors linkages.

25. The maintenance stand of claim 24 wherein said other flight is said lower flight.

26. The maintenance stand of claim 23 wherein each of said flights includes a pair of upper tread stringers and a pair of lower tread stringers, said upper tread stringers of said lower flight and said lower tread stringer of said upper flight being pivotally connected to said intermediate platform on said fifth axis.

27. The maintenance stand of claim 23 including a cooling air duct extending between said base frame and said worker platform support frame including rigid tube sections secured, respectively, to said base frame, said worker platform support frame and said inner arms of one of said scissors linkages and flexible tube sections interconnecting said rigid tube sections adjacent said second, third and fourth axes.

* * * * *